United States Patent [19]

Lehmann et al.

[11] Patent Number: 4,947,902

[45] Date of Patent: Aug. 14, 1990

[54] DEVICE FOR TWISTING WIRES FOR CONNECTING RODS

[75] Inventors: Peter Lehmann, Kirchdorf; Heinrich Glaus, Niederwangen, both of Switzerland

[73] Assignee: Styner & Bienz AG, Niederwangen, Switzerland

[21] Appl. No.: 354,778

[22] Filed: May 22, 1989

[30] Foreign Application Priority Data

May 24, 1988 [CH] Switzerland ..... 81032/88

[51] Int. Cl.[5] ..... B21F 15/04

[52] U.S. Cl. ..... 140/119; 140/93 A; 294/82.34

[58] Field of Search ..... 140/93 A, 93.6, 118, 140/119; 294/82.34

[56] References Cited

U.S. PATENT DOCUMENTS

| | | | |
|---|---|---|---|
| 1,436,637 | 11/1922 | Bates | 140/119 |
| 1,681,610 | 8/1928 | Foulder | 140/119 |
| 3,273,605 | 9/1966 | Ferrara | 140/119 |

FOREIGN PATENT DOCUMENTS

| | | | |
|---|---|---|---|
| 2432263 | 1/1976 | Fed. Rep. of Germany . | |
| 2559796 | 12/1980 | Fed. Rep. of Germany | 294/82.34 |
| A8701753 | 3/1987 | World Int. Prop. O. . | |

*Primary Examiner*—Lowell A. Larson

*Attorney, Agent, or Firm*—Marks Murase & White

[57] ABSTRACT

The device for twisting wires has a twisted rod with a binding hook, which is set into rotation upon pulling a handle part. The binding hook is pivotable around an axle and is held in the normal position by a stop slider engaging in recesses of the binding hook. When the wire loop around the binding hook is tightened, a catch is lifted up, whereby the stop slider and thus the binding hook are unlocked and pivoted, so that it can slip from the wire loop.

Such a device enables a constant, optimum twisting of the wire without the risk of rupture thereof, and it permits automatic release of the binding hook by one and the same pulling movement.

13 Claims, 3 Drawing Sheets

DEVICE FOR TWISTING WIRES FOR CONNECTING RODS

BACKGROUND OF THE INVENTION

The present invention relates to a device for twisting wires, with a twisted rod provided with a binding hook which is set into rotation upon pulling a handle part, for connecting rods, in particular steel reinforcement rods.

A plurality of devices for twisting wires are known as well as formed wires for carrying out the securement of steel reinforcement rods, this work mostly being performed by specialists under contract. The steel rods used for the fabrication of reinforced concrete constructions usually lie one above the other orthogonally and have to be interconnected at their points of intersection. Currently, a simple apparatus prevails which depends mainly on the specialized worker's skill and stamina. In such a case, prefabricated wire loops are used which have rings or eyelets at both ends. As a result of the required flexibility and, hence, minimum thickness of the wire, for safety reasons two of these wire loops at a time are manually placed around the rods to be connected, and the four wire eyelets are seized by a twisting apparatus at the top. This twisting apparatus comprises a rod with a hook, the rod being twisted and moving in a corresponding handle, so that the rod and, consequently, the hook, are set into rotation upon pulling the handle. About at the end of the twisting procedure, which is a matter of the operator's experience and skill exclusively, the hook is drawn out from the rings or eyelets. If the wire loops are tightened too strongly, it may occur that they break. Therefore, the people working under contract will be careful not to tighten the loops too strongly, which may result in a too loose connection. In addition, the production of the wire loops with two rings or eyelets, two of which have to be used in general, is relatively work-expensive and requires much material, which plays an important role considering the great quantities needed.

SUMMARY OF THE INVENTION

Based on this, it is the object of the present invention to provide a device for twisting wires which always guarantees maximum securement and enables automatic disengagement of the binding hook from the loop, as well as a formed wire which is easy to produce, saves material and guarantees a safe and solid connection. To achieve this object, the device for twisting wires according to the invention is provided with a knurled rod having a binding hook which is set into rotation upon pulling a handle part, said binding hook being provided with means to release the same from the wire loop encircling it when the desired tightness of the connection is attained.

The device of the invention may be used particularly advantageously in connection with a device for connecting at least two rods according to PCT-A-WO87/01753, according to which the connection of two steel reinforcement rods is effected from above, without having to insert the wire underneath the steel rods by hand.

BRIEF DESCRIPTION OF THE DRAWING

The invention will be explained in more detail with reference to a drawing of embodiments hereinafter.

DESCRIPTION OF THE PREFERRED EMBODIMENTS

Figure 1:
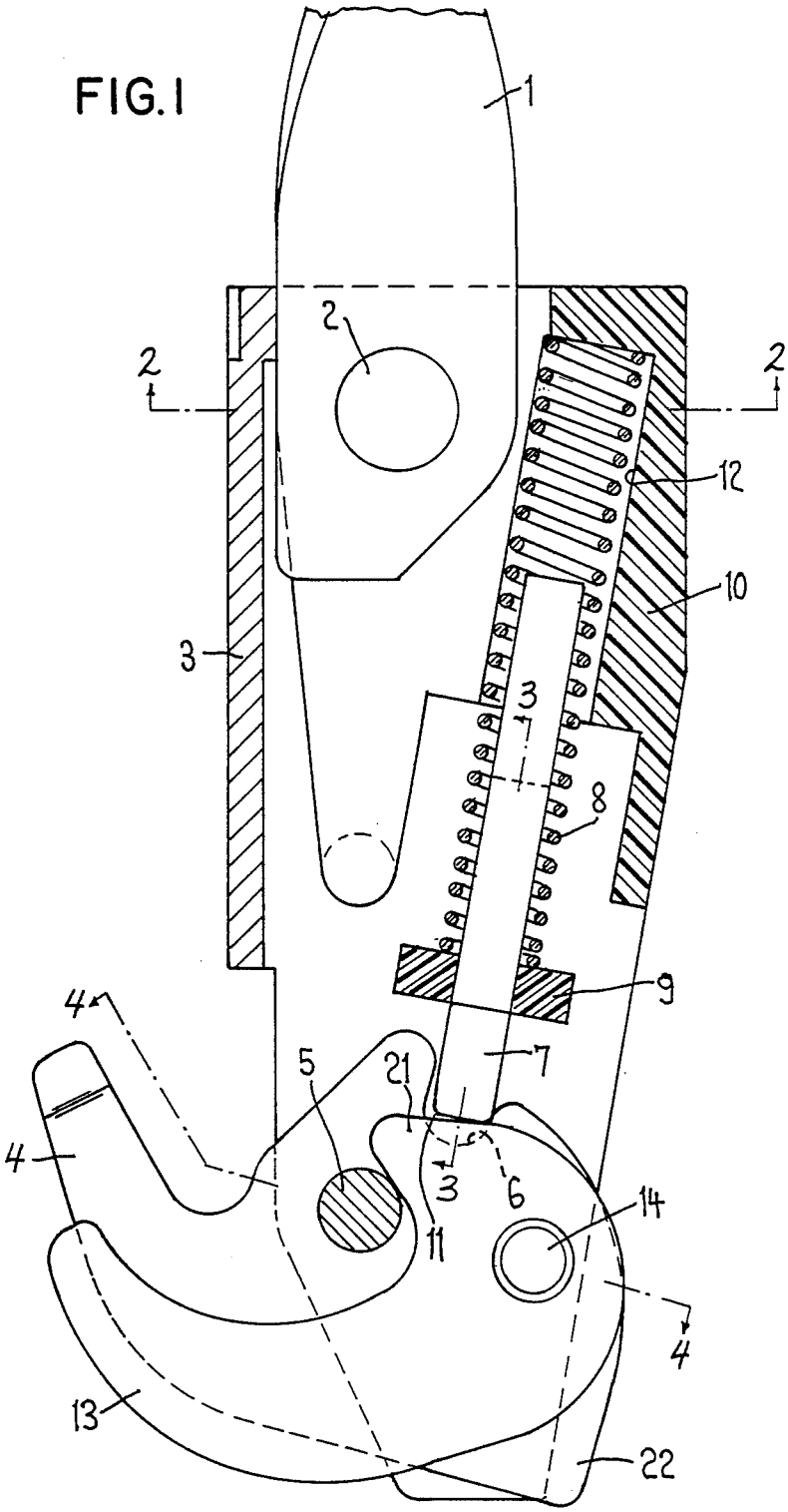
FIG. 1 shows, in a side view and partially sectioned, the inventively essential part of the twisting device.
Figure 4:
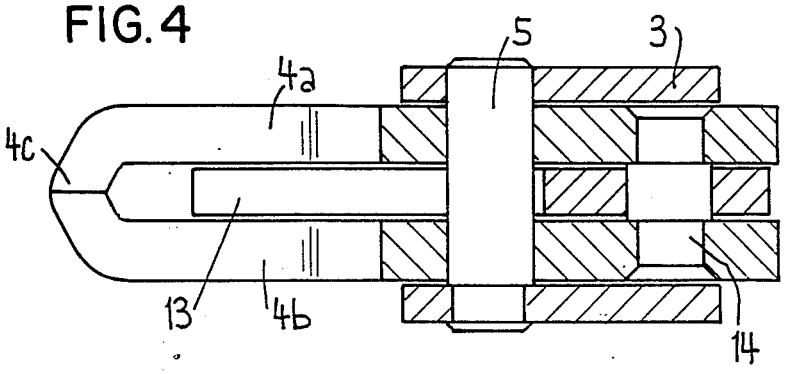
FIG. 4 shows a section along the line IV—IV of FIG. 1.

In FIG. 1, the lower part of a device is illustrated, i.e. the binding hook and a mechanism for pivoting and releasing the same. Through this releasing mechanism it is possible to twist the wires and to pull the binding hook from the loop with one single pulling movement. At the top, one recognizes the end of the twisted rod 1 which is connected to a housing 3 by a rivet 2. In known apparatuses, the twisted rod and the binding hook are simply one piece. In the embodiment according to the invention, however, the binding hook 4 is connected to the lower part of the housing 3 by an axle 5, as is apparent from FIG. 4 in particular. As illustrated in FIG. 4, the binding hook 4 is made of two parts, its two legs **4*a* and 4*b* being bent at the front, i.e. at the end 4*c*** of the hook, and riveted together at the rear.

Figure 2:
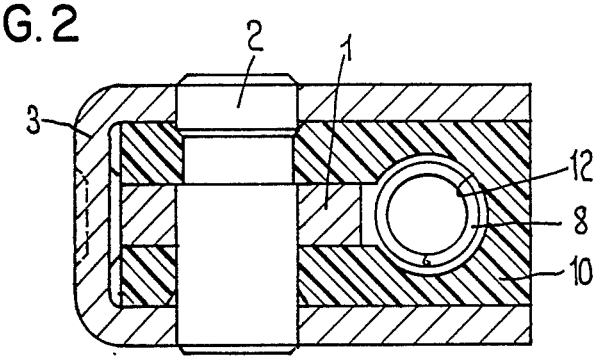
FIG. 2 shows a section along the line II—II of FIG. 1.
Figure 3:
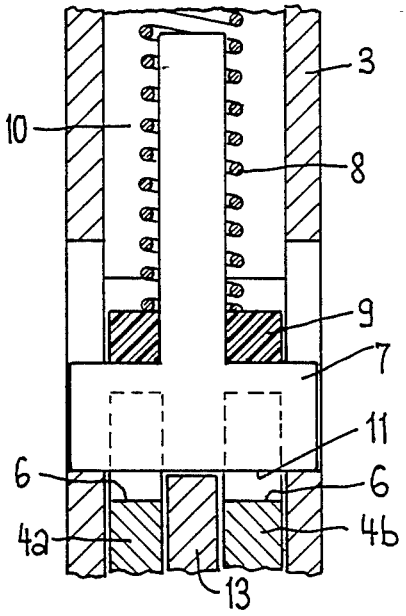
FIG. 3 shows a section along the line III—III of FIG. 1.

On their sides facing the twisted rod, opposite the hook end, the legs **4*a* and 4*b* are provided with a recess 6 each, in which a stop slider 7 engages. According to FIG. 3, this stop slider is T-shaped and it is pressed into the recesses 6 by a pressure spring 8, the pressure spring S acting onto a guide washer 9 which rests on the short legs of the stop slider. The pressure spring 8 with the leg of the stop slider 7 moving inside is guided in a hole 12 of a guiding piece 10, and its other end rests there. The guiding piece 10 is secured in the housing 3, see FIG. 2. The lower edges 11 of the stop slider, which engage in the recesses 6**, are only little rounded off in order to provide for good locking.

The stop slider 7 not only acts onto the binding hook 4, but also onto a catch 13 which is arranged rotatively around a pin 14 and inside the two legs **4*a* and 4*b* of the binding hook. Now, if the catch 13 is moved upwards around the pin 14, i.e. in the direction of the knurled rod, the stop slider 7 is moved upwards against the pressure of the spring 8, in order to release the binding hook pivotable around the axle 5**.

Figure 5:
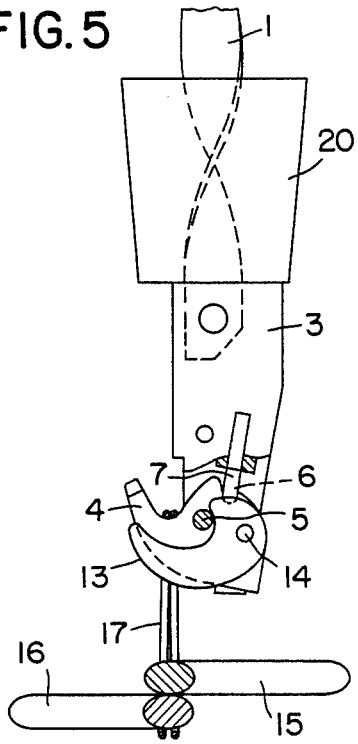
FIGS. 5 to 7 show three phases of the twisting procedure using the device according to FIG. 1.
Figure 6:
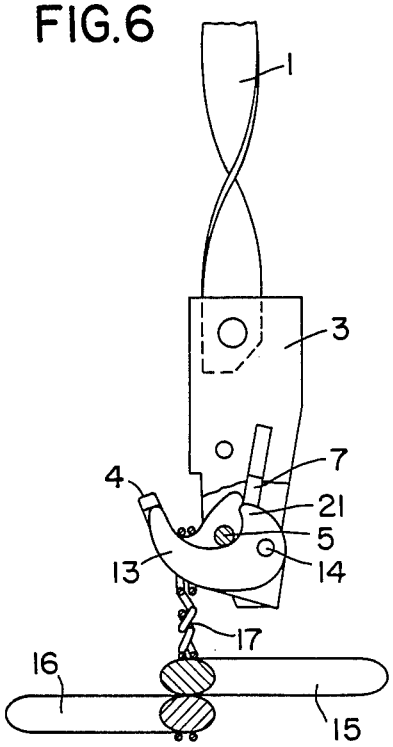
Figure 7:
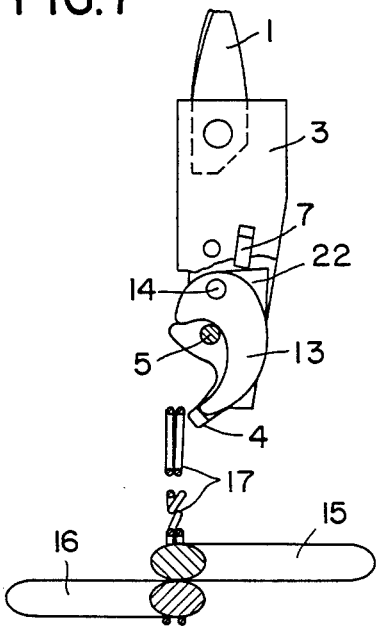
Figure 8:
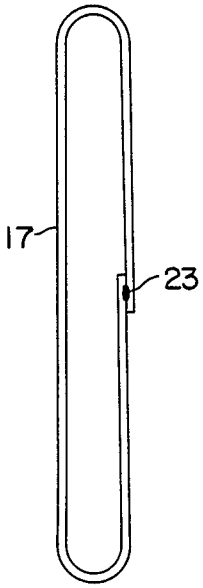
FIG. 8 shows a formed wire to be used with the invention.

This releasing process is illustrated in FIGS. 5 to 7 by means of three distinct phases. In these Figures, the two reinforcement rods 15 and 16 to be connected, as well as the wires to be twisted, are represented in the phase in which the binding hook and the catch engage in the upper part of the formed wire. This can be the wire loop 17 according to FIG. 8, wire clamps according to the above-mentioned PCT-A-WO87/01753, as will be explained hereinafter, or still other formed wires. Twisting of the wires, resp. rotation of the twisted rod is caused by a handle 20, which is only symbolically indicated here and which is provided with a through opening adapted to the cross-section of the twisted rod. As a result of the twisting, the catch 13 is pushed upwards to come into an approximately congruent position with the binding hook 4. In the position of FIG. 6, the notch part 21 of the catch 13 has lifted the stop slider 7 out from the recesses 6, so that upon further pulling, i.e. during the transition to the position according to FIG. 7, the binding hook and the catch are released, and, when pulling further, the hook and the catch slip from the upper part of the formed wire in FIG. 7. In this position, the stop slider 7 now presses onto the rear end 22 of the binding hook and brings this and the catch 13 back into the initial position according to FIG. 5.

By this automatic release of the binding hook it is achieved, on one hand, that the formed wires are always tightened equally, and on the other hand, first of all, that their rupture by too vehement and too long pulling is made impossible. As already mentioned above, such an automatic release of the wire clamps is particularly advantageous if a method and a device for connecting at least two rods according to PCT-A-WO87/01753 are chosen, for this method and this device permit particularly quick work even by non-specialized people. Moreover, the handle part of this device is formed such that a relatively great force is applied on the twisted rod; thus, there may be a risk that the wires break, which is avoided by the present invention. Besides, the wire clamps described there are particularly adapted to pulling the catch up and to release the binding hook.

However, the present invention is not only suitable for this method and device for connecting at least two rods, but for any device for twisting wires. There are places on a construction site where a simple traditional twisting apparatus may be advantageous, and for such an apparatus, the twisting device's lower end according to the invention is equally suitable.

Figure 9:
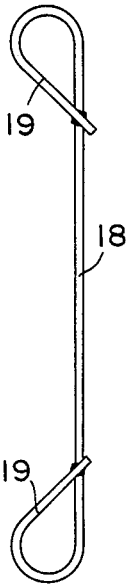
FIG. 9 shows a known wire loop.

For such a simple apparatus, the formed wire parts, resp. formed wires 18 with the eyelets 19 according to FIG. 9 are known, two of them being generally used at a time in order to obtain the desired strength. In order to simplify production—four welding points, as two formed wires 18 have to be used—and application—two formed wires having to be used at a time—, the single wire loop 17 according to FIG. 8 was created which needs only one welding point 23 and of which only one loop has to be used at a time. The twofold U-shaped bending and the single welding of the wire loop 17 necessitates less complicated tools and substantially less wire, whereby production costs can be reduced once more. In order to adapt the device to different formed wires and different sorts and sizes of wires it may be advantageous to exchange the pressure spring or to adjust its tension.

Use and design of twisting devices are not limited to the building industry. In the packing industry or in viniculture, twisting devices are also used which may be equipped with the releasing mechanism described above, and the wire loop according to the invention ma be.used there too.

We claim:

1. A device for turning at least one wire loop so as to twist a plurality of wires, the device comprising;

a knurled rod;

a handle surrounding the knurled rod, the handle having an opening formed therein through which the knurled rod extends;

the handle and the knurled rod being configured such that when the handle is pulled, the knurled rod rotates;

a binding hook operatively connected to the knurled rod for rotation therewith, the binding hook including a portion adapted to hook under each said wire loop, whereby rotation of the knurled rod results in rotation of the binding hook, rotation of each wire loop hooked by the binding hook and twisting of the wires to be connected; and a release mechanism for allowing the binding hook to disengage the wire loops, the release mechanism being actuated by the twisted wires when a desired tightness of connection is attained.

2. A device according to claim 1, wherein the binding hook is arranged pivotably about an axle;

the device further comprising a locking device for holding the binding hook in an initial position with respect to the knurled rod; and wherein the release mechanism comprises a catch which is moved by at least one of the wires upon tightening of the twisted wires from an initial position to a position in which the catch unlocks the locking device when the desired tightness is attained.

3. A device according to claim 2, wherein the binding hook comprises two legs, each of the legs having opposed ends and opposed sides, the legs each being bent at the front and being provided with a recess on the side closest to the knurled rod; and wherein the locking device comprises a T-shaped stop slider and a spring which biases the stop slider into the recesses and wherein the catch pushes the T-shaped stop slider against the bias of the spring in response to tightening of the twisted wires and entirely out of the recesses when the desired tightness is attained.

4. The device of claim 3, wherein the rear end of the binding hook and the catch are shaped such that both the binding hook and the catch are returned to their initial positions under the action of the stop slider after the binding hook is disengaged from the wire loops.

5. The device of claim 4, further comprising a housing, the housing having a first end to which the knurled rod is connected and a second end to which the binding hook and catch are connected such that the binding hook and catch are operatively connected to the knurled rod via the housing.

6. The device of claim 5, wherein the T-shaped stop slider has two short legs and one long leg and wherein the locking device further comprises a guide washer slidably mounted on the long leg, the guide washer being biased against the short legs of the T-shaped stop slider by the spring;

the device further comprising a guiding piece provided in the housing, a hole being formed in the guiding piece;

and wherein the spring is supported by the guide washer and in the hole formed in the guiding piece.

7. A device according to claim 1, wherein the handle further comprises closing jaws for bringing locking members of a wire clamp into engagement.

8. A device for turning at least one wire loop so as to cause twisting of at least two wires, the device comprising;

a rod having a longitudinal axis;

a handle surrounding the rod, the handle having an opening formed therein through which the rod extends;

the handle and the rod being configured such that when the handle is pulled, the rod rotates;

a binding hook operatively connected to the rod for rotation therewith, the binding hook being pivotable with respect to the rod, the binding hook having, at one end thereof, a portion adapted to hook under a wire loop, and at another end thereof a recessed portion;

a locking detect, the locking detent being slidable into the recess for preventing pivoting of the binding hook with respect to the rod so as to hold the binding hook in an initial position and out of the recess so as to permit pivoting of the binding hook with respect to the rod;

a spring biasing the locking detent into the recess;

a lock releasing catch, the catch being moved by at least one of the twisted wires upon tightening of the twisted wires from an initial position to a position in which the catch pushes the locking detent out of the recess, the detent being pushed entirely out of the recess when the desired tightness is attained so as to disengage the binding hook.

9. The device of claim 8, wherein the binding hook and the catch are shaped such that both the binding hook and the catch are returned to their initial positions under the action of the spring biased detent after the binding hook is disengaged.

10. The device of claim 8, wherein the binding hook comprises two legs, each of the legs being bent at an end thereof which is spaced from the recess formed in the binding hook.

11. The device of claim 8, wherein the locking detent comprises a T-shaped stop slider.

12. The device of claim 8, further comprising a housing, the housing having a first end to which the rod is connected and a second end to which the binding hook and catch are connected such that the binding hook and catch are operatively connected to the rod via the housing.

13. The device of claim 8, wherein the rod includes a helical thread and the housing includes a portion engaging the helical thread such that movement of one of the rod and housing along the longitudinal axis of the rod with respect to the other one of the rod and housing causes rotation of the other member.

* * * * *

UNITED STATES PATENT AND TRADEMARK OFFICE

CERTIFICATE OF CORRECTION

PATENT NO. : 4,947,902

DATED : August 14, 1990

INVENTOR(S) : LEHMANN et al.

It is certified that error appears in the above—identified patent and that said Letters Patent is hereby corrected as shown below:

ON THE TITLE PAGE

Item [30] Foreign Application Priority Data "May 24, 1988 Switzerland. . .81032/88" should be --May 24, 1988, Europe. . . 88810327.2--.

Signed and Sealed this

Twenty-first Day of January, 1992

*Attest:*

HARRY F. MANBECK, JR.

*Attesting Officer*

*Commissioner of Patents and Trademarks*